United States Patent [19]

Lawrence et al.

[11] Patent Number: 4,886,084

[45] Date of Patent: Dec. 12, 1989

[54] PANELIZED FABRIC COVERED STRUCTURE

[75] Inventors: George W. Lawrence, Yarmouth; C. William Moss, Portland, both of Me.

[73] Assignee: Omar, Inc., Portland, Me.

[21] Appl. No.: 103,918

[22] Filed: Oct. 1, 1987

[51] Int. Cl.[4] ..... E04B 1/34

[52] U.S. Cl. ..... 135/103; 135/DIG. 8; 135/101; 52/80; 52/471

[58] Field of Search ..... 52/80, 101, 471, 222; 135/97, 103, 104, 115, DIG. 8, 102

[56] References Cited

U.S. PATENT DOCUMENTS

| | | | |
|---|---|---|---|
| D. 230,724 | 2/1966 | Infomte . | |
| 2,388,701 | 11/1945 | Neff . | |
| 2,822,898 | 2/1958 | Richards | 52/471 |
| 2,961,802 | 11/1960 | Mongan et al. | 52/80 |
| 3,075,654 | 1/1963 | Wheeler . | |
| 3,137,097 | 6/1964 | Zeinetz | 52/80 |
| 3,143,939 | 8/1964 | Gregoire | 52/471 |
| 3,161,553 | 12/1964 | Visser . | |
| 3,252,469 | 5/1966 | Peake | 52/80 |
| 3,277,219 | 10/1966 | Turner . | |
| 3,473,272 | 10/1969 | Hasselquist | 52/80 |
| 3,475,768 | 11/1967 | Burton | 52/80 |
| 3,572,002 | 8/1969 | Nichols | 52/86 |
| 3,619,432 | 11/1971 | Harrigton . | |
| 3,668,287 | 6/1972 | Mackle . | |
| 3,751,862 | 8/1973 | Linecker | 52/80 |
| 3,773,061 | 11/1973 | Berger | 135/101 |
| 3,886,961 | 6/1975 | Geiger et al. | 52/80 |
| 3,982,361 | 9/1976 | Deutsch et al. | 52/80 |
| 4,064,663 | 12/1977 | Moss | 52/80 |
| 4,115,480 | 9/1978 | Cowman, Jr. et al. | 52/80 |
| 4,593,710 | 6/1986 | Stafford et al. | 135/102 |
| 4,603,528 | 8/1986 | Sigerist | 52/471 X |
| 4,644,706 | 2/1987 | Stafford et al. | 135/102 |
| 4,736,551 | 4/1988 | Higson | 52/80 |

*Primary Examiner*—Carl D. Friedman
*Assistant Examiner*—Caroline D. Dennison
*Attorney, Agent, or Firm*—Joseph S. Iandiorio; Brian M. Dingman

[57] ABSTRACT

A panelized fabric-covered structure with removable and replaceable fabric panels including an expandable frame having a plurality of frame members for holding a fabric cover, a fabric cover including a plurality of discrete fabric panels each having at least one enlarged edge, and a connector for connecting the enlarged edges of the fabric panels to each other and to the frame and allowing the panels to slide and seat as the frame is expanded.

30 Claims, 7 Drawing Sheets

PANELIZED FABRIC COVERED STRUCTURE

FIELD OF INVENTION

This invention relates to a panelized fabric covered structure and more particularly to an expandable structure with removable and replaceable fabric panels that move and seat as the structure is expanded.

BACKGROUND OF INVENTION

Conventional fabric-covered structures are typically permanent shelters that are made from a frame including four or more rigid arches interconnected at the top and bottom by a plurality of rigid transverse members. The frame is first assembled and then covered with a one-piece fabric cover that is attached to the frame members. Typically, the frame is made of U-shaped structural members and the fabric is stuffed in the open side of the members. This holds the fabric in place once the structure is assembled.

The assembled structure is then typically coated or sprayed with cement or a rigid plastic foam material. When hardened, this material forms a permanent roof that has the same shape as the fabric cover. The fabric roof form can then be removed and re-used in the fabrication of other shelters. Thus, this structure does not have a removable and replaceable fabric roof which is both functional and esthetically pleasing. U.S. Pat. No. 4,064,663 is an example of this type of permanent shelter.

Alternatively, the fabric cover can be left uncoated. In this case, the cover becomes the roof of the shelter. However, when the fabric wears and has to be replaced, or the occupant desires to replace the cover for aesthetic reasons, quite a bit of work is involved. The structure must first be partially disassembled to loosen the fabric cover. Then, the cover is removed as a unit by pulling or sliding it off of the structural members. This sequence is repeated in reverse for the installation of a new cover. However, the size and weight of the one-piece cover make it extremely unwieldy, which makes the replacement process difficult and time consuming.

Because the frame is relatively difficult to assemble and the cover relatively difficult to replace, these fabric-covered shelters are not ideal, permanent or semi-permanent, modular buildings. Rather, they are typically simply fairly small, temporary shelters that are not well suited for permanent habitation. The shelters that are well suited for permanent habitation typically do not have removable and replaceable fabric covers and are therefore not true fabric covered structures.

SUMMARY OF INVENTION

It is therefore an object of this invention to provide a panelized fabric-covered structure with removable and replaceable fabric panels.

It is a further object of this invention to provide a panelized fabric-covered structure with an expandable frame.

It is a further object of this invention to provide a panelized fabric-covered structure which can be put together without stress to facilitate erection.

It is a further object of this invention to provide panelized fabric-covered structure with interchangeable fabric panels.

It is a further object of this invention to provide a panelized fabric-covered structure in which the fabric panels can be selectively tensioned to add strength to the structure.

It is a further object of this invention to provide a panelized fabric-covered structure in which the fabric panels can be selectively loosened to facilitate removal and replacement of individual fabric panels.

It is a further object of this invention to provide a panelized fabric-covered structure in which the fabric panels can slide and rotate relative to the frame and each other to seat and tension the panels as the structure is expanded.

It is a further object of this invention to provide a panelized fabric-covered structure which is semi-permanent or permanent yet has a fabric cover which is easily replaced.

It is a further object of this invention to provide a panelized fabric-covered structure which is modular to offer unlimited variation in size to meet living space requirements.

It is a further object of this invention to provide a panelized fabric-covered structure in which the fabric panels can be layered to create space for insulation or interlayer air movement.

This invention results from the realization that fabric-covered structures can be improved considerably by providing an expandable frame with adjustable length frame members, and connecting individual, removable fabric panels to the frame members and each other with a welt connector that allows the panels to shift and slide relative to one another to seat the panels as they are slid on the frame and tension the panels as the frame members are lengthened.

This invention features a panelized fabric-covered structure with removable and replaceable fabric panels. The structure includes an expandable frame having a plurality of frame members for holding a fabric cover. The fabric cover includes a plurality of discrete fabric panels, each panel having at least one enlarged edge. The structure also includes connector means for connecting the enlarged edges of the fabric panels to each other and to the frame and allowing the panels to slide and seat as the frame is expanded. The structure may further include means for expanding the frame and tensioning the fabric panels. This means for expanding preferably includes means for adjusting the length of selected frame members.

In a preferred embodiment, the connector means includes at least one channel member for engaging with an enlarged edge of one of the fabric panels. The enlarged edge preferably includes a welt attached to an edge of the fabric panels to provide sliding engagement with the channel member to allow the fabric panels to be removed and replaced. Preferably, the channel member includes a partially open annular conduit, and the enlarged edge includes a substantially cylindrical welt attached to an edge of the fabric panels to provide sliding and rotational engagement between the fabric panels and the connector means. Preferably, this welt is a continuous, elongate member which is wider than the opening in the annular section to provide interlocking sliding and rotational engagement between the fabric panels and the connector means.

The frame preferably includes a plurality of arch members facing a common center and a plurality of transverse members interconnecting the arch members. Each arch member may include at least one substantially vertical member for holding a rigid structure such as a wall, door or window. Preferably, means for adjusting the lengths of the transverse members and the height of the arch members to expand the frame and tension the fabric panels are included. The arch members may be pivotally attached to a supporting surface. This allows the arch members to pivot out when the transverse members are lengthened to tension the fabric panels.

In a preferred embodiment, the means for adjusting the height of the arch members provides independent adjustment of the length of each leg of each arch member. In addition, each transverse member preferably extends from the apex of an arch member toward the center of the structure. In this embodiment, the structure also includes a central hub member for interconnecting the transverse members. This hub member may be supported by a central support member which provides support for the hub member and the frame structure.

The structure may also include a connecting structure for attaching arch members of closely spaced structures together. This connector preferably includes at least one fabric panel, and may further be used to connect identical structures to make the fabric-covered structure design modular.

Preferably, the fabric cover includes a plurality of spaced layers of fabric panels. These panels may be interchangeable. There may also be included insulation means for filling the space between at least two of the layers, or a fan for circulating the air between the layers.

Solar heating of the structure can be accomplished by including a top fabric layer made of translucent fabric panels which transmit sunlight. The bottom fabric layer may include fabric panels having a dark surface for absorbing radiant energy. Alternatively, the bottom fabric layer may include fabric panels having a reflective surface for reflecting radiant energy. Preferably, these bottom panels have a dark surface facing out and a reflective surface facing in. The dark surface absorbs solar radiation and heats the air held between the fabric layers, and the reflective surface reflects radiant energy which would otherwise be lost through this fabric layer.

In an alternative preferred embodiment, the structural frame members include channel members. The opening in the structural channel members may be sealed by a cap member which protects the fabric held in the opening from exposure to sun and moisture. The structure may also include a central opening in the cover for venting the interior. Preferably, a screened or translucent cover is provided for this opening, and a raised cap covers the opening to keep rain and snow out.

A panelized fabric-covered structure with removable and replaceable fabric panels according to this invention may also be accomplished by including an expandable frame having a plurality of frame members. These frame members include a plurality of arch members facing a common center and a plurality of transverse members interconnecting the arch members. The frame holds a fabric cover which includes a plurality of discrete fabric panels. Each panel has at least one enlarged edge. There are also means for fastening the arch members to a supporting surface and means for adjusting the length of the selected frame members to expand the frame and tension the fabric panels. The enlarged edges of the fabric panels are connected to each other and to the frame by a connector means which allows the panels to slide and seat as the frame is expanded. Preferably, this connector means includes at least one partially open annular conduit section. The enlarged edges of the fabric panels may further include a substantially cylindrical welt which is wider than the opening in the annular conduit and is attached to the edge of the fabric panels to provide interlocking sliding and rotational engagement between the fabric panels and the connector means.

A panelized fabric-covered structure with removable and replaceable fabric panels according to this invention may further be accomplished by including a frame having a plurality of frame members for holding a fabric cover, and a fabric cover including a plurality of discrete fabric panels, each having at least one enlarged edge. The enlarged edges of the fabric panels are connected to the frame and each other by channel member connector means that allow the panels to slide and seat as the panels are tensioned.

The structure also includes means for tensioning the fabric panels. Preferably, this means for tensioning includes means for adjusting the length of selected frame members. The channel member connector means preferably includes a partially open annular conduit, and the enlarged edge of the fabric panels is preferably made by including a substantially cylindrical welt wider than the opening in the conduit and attached to an edge of the fabric panels to provide interlocking sliding and rotational engagement between the fabric panels and the connector means.

Another preferred panelized fabric-covered structure with removable and replaceable fabric panels includes an expandable frame including a plurality of frame members for holding a fabric cover, and a fabric cover including a plurality of discrete fabric panels each having at least one enlarged edge including a substantially cylindrical welt attached to the edge. The enlarged edges of the fabric panels are connected to each other and to the frame by partially open annular conduit connector means that allow the panels to slide and rotate to seat the panels as the frame is expanded and the panels tensioned. The structure also includes means for adjusting the length of selected frame members to expand the frame and tension the fabric panels. Preferably, the welt is wider than the opening in the conduit to provide interlocking sliding and rotational engagement between the fabric panels and the connector means.

DESCRIPTION OF PREFERRED EMBODIMENT

Other objects, features and advantages will occur from the following description of a preferred embodiment and the accompanying drawings, in which.

Figure 1:
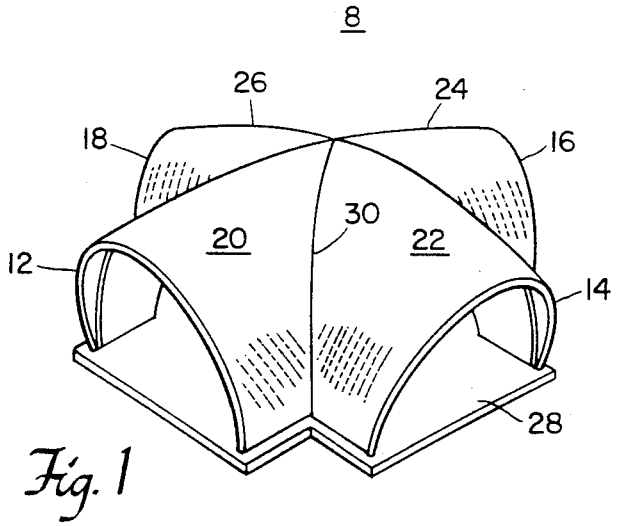
FIG. 1 is an econometric view of a panelized fabric-covered structure according to this invention.

A panelized fabric-covered structure with removable and replaceable fabric panels according to this invention may be accomplished with an expandable frame which holds a fabric cover made from a number of fabric panels. Preferably, the frame is made expandable by attaching selected frame members together with telescoping connectors that provide adjustment of the length of these frame members. Each of the fabric panels has at least one enlarged edge. The fabric panels are connected to the frame members and each other by a welt connector that allows the fabric panels to be slid onto the frame and seat as the frame is expanded. This movement also allows each of the panels to be properly tensioned as the structure is expanded. Individual fabric panels can be slid off the frame and replaced without disassembling the frame or removing the whole fabric cover by simply shortening the telescoping connectors to loosen the fabric panels. These telescoping connectors allow selective tensioning and loosening of individual fabric panels to facilitate replacement.

The welt connector preferably includes at least one channel member. This channel member is preferably a partially open annular conduit. A welt sewn into the edge of the fabric panels slidingly engages with this annular conduit. The welt is preferably a round, plastic, elongated cylindrical member that is wider than the opening in the annular conduit. This arrangement allows individual fabric panels to be connected to each other and to the frame members, and provides interlocking, sliding engagement between the fabric panels and the frame members. Rotational engagement is also provided in the preferred annular conduit/cylindrical welt embodiment. This engagement allows the fabric panels to move and seat as the frame is expanded and the panels tensioned, and also allows individual panels to be removed from the structure and replaced.

Preferably, the structure includes a number of arch members arranged facing a common center. Each arch member is preferably made of two half-arch members bolted together. This makes it easier to transport and assemble the structure. The arch members also preferably include at least one vertical member. After the structure is assembled, walls, doors, or windows can be attached to these vertical studs to make the structure a more comfortable permanent habitation.

The arch members are interconnected by a number of transverse members. Preferably, a telescoping connector is used to connect each of the transverse members to the apex of an arch member. There is also preferably a telescoping connector connecting each leg of each arch member to a supporting structure such as a wooden platform or a poured concrete floor, or to the ground.

In a preferred embodiment, each transverse member extends from the apex of an arch toward the center of the structure. These transverse members are then interconnected at the center of the structure by a central hub bolted to all of the transverse members. The structure may also include a center support pole attached to the hub. This support pole adds further support to the structure during erection, but may be removed if the additional support is not needed for heavy snow or wind loads. This also provides a completely open living space within the fabric-covered structure.

The fabric-covered structure is preferably erected by first assembling all of the frame members, including the arch members and the transverse members which interconnect them. The arch members are raised and connected to the supporting surface with a telescoping connector. This connector is adjusted by an adjustment nut that is driven by a power tool such as variable speed drill with a socket driver attached. These connectors allow the height of the arch members to be adjusted in ten seconds or less. The arch members may be pivotally attached to this connector by a bolt and slot arrangement. The arch members are then interconnected by transverse members that run from the apex of each arch to the center of the structure. Each transverse member is preferably attached to the apex of an arch by another telescoping connector. The transverse members then are all interconnected at the center of the structure by a central hub bolted to each of the structural members.

Once the frame is assembled in this manner, the fabric cover is put in place. The fabric cover is made from a plurality of individual fabric panels. Each of the panels has an elongated, continuous, cylindrical welt sewn into its edges. This welt is shaped to slidingly engage and interlock with the welt connectors that are attached to the frame members. Each welt connector has one or more partially open annular conduit sections with an opening which is smaller than the welt on the edge of the fabric panels. This connector arrangement allows each of the panels to be individually attached to the frame and to each other. The panels are simply slid into place by engaging the welts with the annular section of the welt connectors. Once all of the panels have been slid onto the frame and are in place, an unsupported double welt connector is slid onto the welts on the free edges of the fabric panels to interconnect adjacent panels. Then, the arch members and then the transverse members are lengthened by the telescoping connectors. This tensions the fabric panels and finishes assembly of the structure. The unique welt connector and welt arrangement allows each individual fabric panel to slide and rotate to "find" its seated position as the frame is expanded and the panels tensioned.

Preferably, the structure has two spaced layers of fabric panels. The panels are also preferably interchangeable. Layering can easily be accomplished by simply attaching a welt connector to the top and bottom of each of the frame members. This arrangement provides a two-layer roof with an air space between the layers that can be used for heating or insulating the structure. In colder climates, the two-layer structure can be insulated by filling this space with insulation. Alternatively, the structure can be solar heated by making the external layer from a translucent fabric, and the inside layer from a fabric that has a dark surface facing out and a reflective surface facing in. The dark surface absorbs the sunlight transmitted through the outer, translucent layer. This absorbed energy heats the air between the fabric layers. By including a fan to circulate air through this space, the heated air is moved out from between the layers and into the interior of the structure. The reflective surface facing the inside of the structure reflects radiant energy and minimizes heat loss through the fabric roof.

A preferred way to provide a two fabric layer structure is to make the frame members from channel members. These channel members can have virtually any shape, but the preferred shape is a U-shape. One welt connector can be attached to the inside of the open side of the channel member, and another can be attached to the outside of the channel member. Another advantage of using a channel member is that one of the welt connectors can be "buried" inside the channel. By then providing a cap which snap-fits over the member and seals the opening, the welt seam sewn into the edges of the fabric panels can be protected from exposure. This protects the seam's threads from the elements and covers the holes created by the thread which can be a source of leaks in the fabric roof. Thus, by burying the seams within the open side of the channel members, and capping the members to seal them against sunlight and moisture, the life of the fabric panels can be lengthened and the structure can be made virtually waterproof. Any exposed seams in a roof valley can be painted with a vinyl paste that effectively seals the seams. Alternatively, the exposed welt seam can be heat welded instead of sewn. This provides a permanently sealed seam that does not need to be waterproofed.

Typically, a central vent is included in the fabric cover. A cap for covering the vent to keep rain and snow out of the structure is then attached to the frame to complete the structure.

The fabric-covered structure can be made modular by including a fabric connecting structure that is attached to the arches of two closely spaced structures. This connector is typically wedge-shaped, and includes welts sewn in its edges for sliding, interlocking engagement with the welt connectors on the arches. The connector can be used to connect two or more identical structures, or to connect different structures together. In this way, additions can be put on the basic structure as living space requirements change.

There is shown in FIG. 1 a panelized fabric-covered structure 8. Structure 8 is made from arch members 12, 14, 16 and 18 interconnected by four transverse members, not shown. The arch members are connected to supporting surface 28 which may be, for example, a wooden platform or a poured concrete floor. The frame is covered with eight fabric panels, four of which, 20, 22, 24 and 26, are shown. Each fabric panel is connected to an arch member, a transverse member, a sill connector and another fabric panel. Where two fabric panels are interconnected, a valley seam such as seam 30 is formed.

Figure 2:
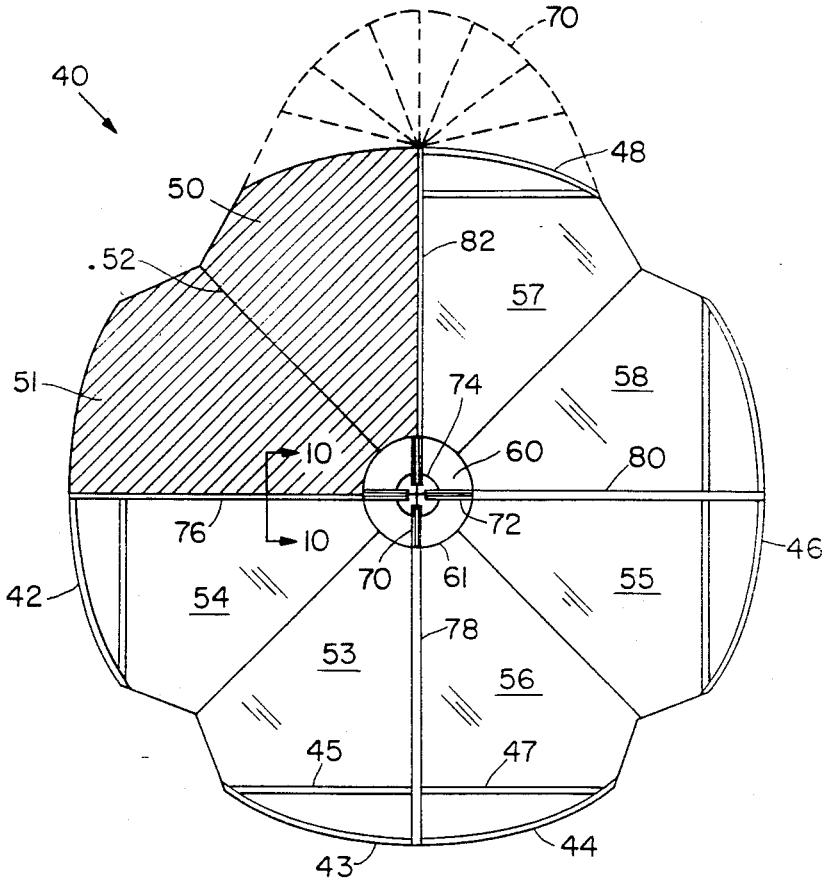
FIG. 2 is a top plan view of another panelized fabric-covered structure according to this invention.

A similar fabric-covered structure is shown from above in FIG. 2. Structure 40 includes a frame made from four arch members and four transverse members. Arch members 42, 44, 46 and 48 are each made of four structural members. For example, arch member 44 is made from full-arch member 43, which itself is two half-arches that are bolted together to form a full arch, and two half-arch members 45 and 47. Transverse member 78 is connected to arch 43 and half-arches 45 and 47. Similarly, transverse members 76, 80 and 82 are connected to the apices of arch members 42, 46 and 48 respectively. The four transverse members are interconnected at the center of structure 40 by hub 74.

The frame is covered by eight fabric panels 50, 51, 53, 54, 55, 56, 57, and 58. Panels 53–58 are made of a transparent fabric to show some of the detail of construction. Each of these fabric panels is connected to a transverse member and an arch member. For example, fabric panel 50 is connected to transverse member 82 and arch member 48. Panel 50 is attached to panel 51 at central seam 52 which forms a valley in the roof of the structure.

The fabric panels are cut to leave central vent opening 60 in the completed structure in which a screened cover can be placed to vent the structure in warm climates. Central vent 60 is shown covered by a clear waterproof cover 61 that is used in cooler climates. Cover 61 is made from crossed supporting arch members 70 and 72, covered with a screen or a clear plastic panel, not shown. This cover is attached to the transverse frame members and the edges of the fabric opening. A cap, not shown, which is larger than vent opening 60 is attached to the transverse frame members and extends above the structure. This cap allows the structure to be vented and prevents rain from falling through vent 60. Extension 70, shown in phantom, is a half-shell fabric extension that can be added to enclose an arch opening and extend the living space. This extension is shown in more detail in FIG. 14.

Figure 3:
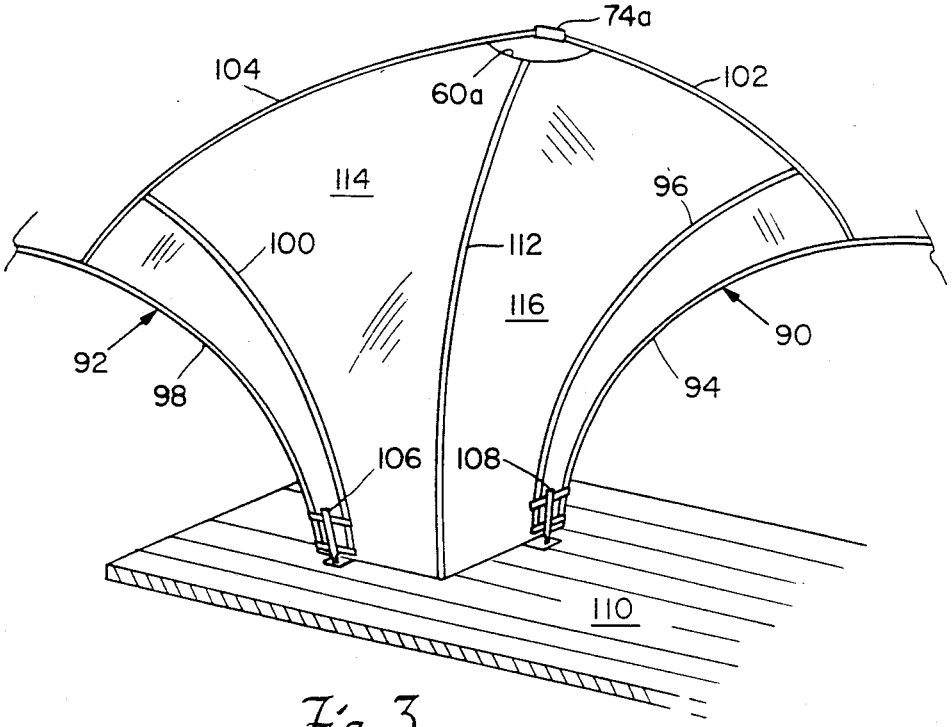
FIG. 3 is a partial axonometric view of a corner of a structure similar to the structure of FIG. 2 viewed from the inside of the structure.

One corner of a four-arch structure is shown from the inside in FIG. 3. Arch member 92 includes full arch 98 and half arch 100, each connected to transverse member 104. Likewise, arch member 90 includes full-arch 94 and half arch 96, each connected to transverse member 102. Half arches 96 and 100 are vertical studs that doors, windows and/or walls can be attached to to make the structure more secure. Arch members 92 and 90 are connected to supporting surface 110 by telescoping connectors 106 and 108 respectively. These telescoping connectors allow adjustment of the height of the arch members. Eighth-section fabric panels 114 and 116 are each connected to one arch member and one transverse member. Panels 114 and 116 are interconnected by welt connector 112. Central vent opening **60*a* is provided by cutting fabric panels 114 and 116 so they fall short of the central hub 74*a***.

Figure 4:
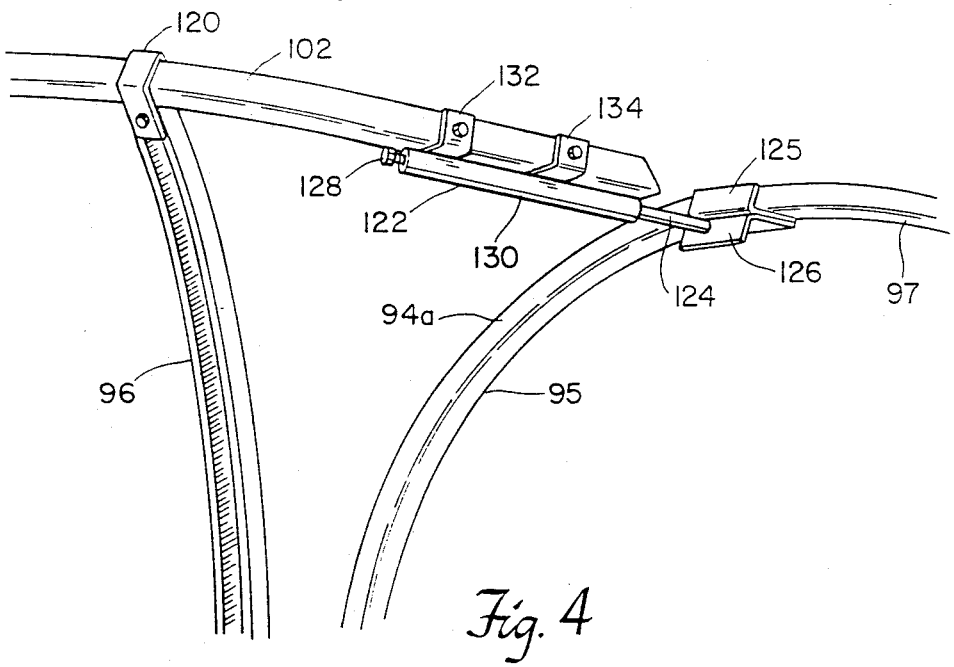
FIG. 4 is an axonometric view of a telescoping connector for connecting a transverse member to an arch member of the panelized fabric-covered structure of FIG. 2.

A telescoping connector for connecting a transverse member to the apex of an arch member is shown in detail in FIG. 4. Full-arch member **94*a* and half-arch member 96 are each connected to transverse member 102. Each of these structural members is a U-shaped channel member. Full-arch member 94*a* is made from two half-arch members 95 and 97 bolted together by connector 125**.

Telescoping connector 122 interconnects transverse member 102 and full-arch member **94*a*. Connector 122** includes tubular body 130 attached to structural member 102 by connecting sleeves 132 and 134. Sliding tube 124 slides in and out of tubular body 130, and is driven by bolt 128. Sliding tube 124 is driven by including a fixed nut, not shown, which engages with the threads on bolt 128. Sliding tube 124 is attached to arch member 94*a* by angle iron 126 bolted to connector 125.

Half-arch member 96 is attached to transverse member 102 by sliding connector 120. Connector 120 is simply a square or U-shaped sleeve that loosely wraps around transverse member 102 and is bolted to half-arch member 96. Since fixed walls, doors, or windows can be attached to half-arch members such as member 96, it is important that they remain plumb. Connector 120 allows half-arch member 96 to remain fixed in a vertical position while transverse member 102 is lengthened and shortened by adjustable connector 122.

Figure 5B:
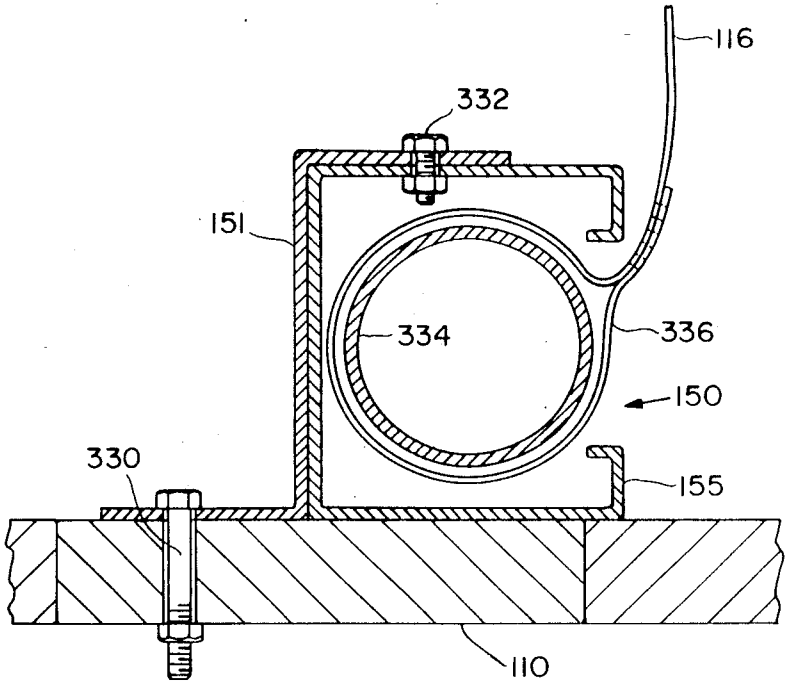
FIG. 5B is a cross sectional view taken along line 5B of FIG. 5A showing a sill connector for anchoring the fabric cover to the supporting surface.
Figure 5A:
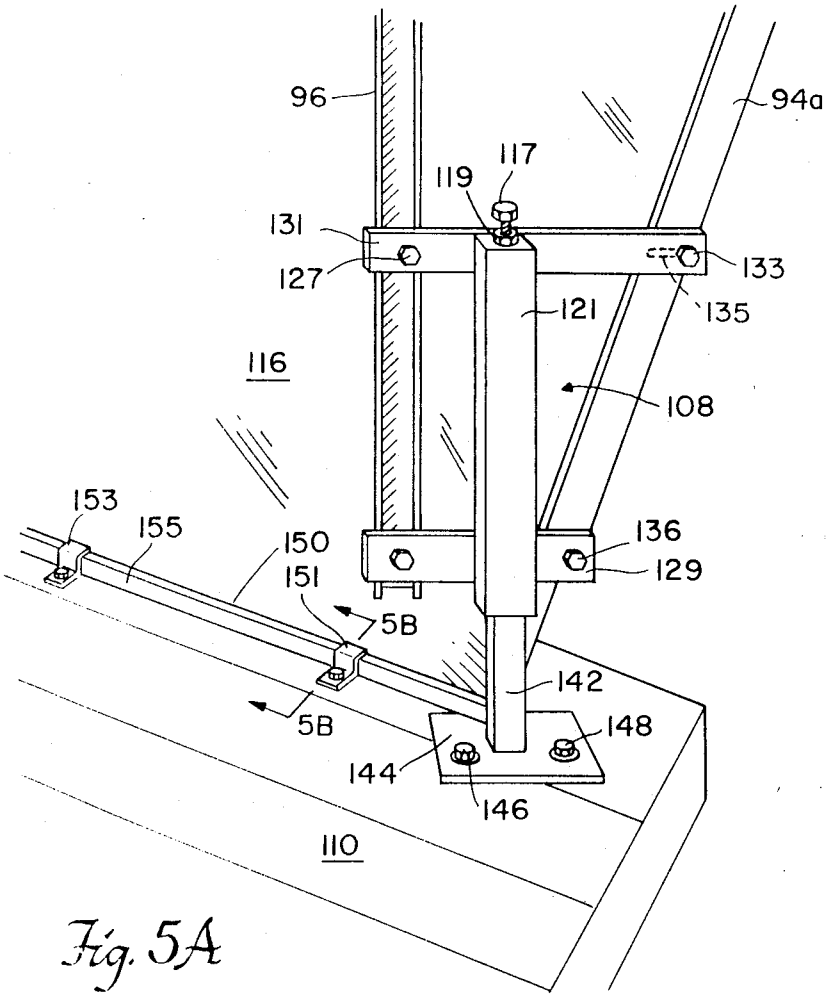
FIG. 5A is an axonometric view of a telescoping connector for connecting the arch member of FIG. 4 to a supporting surface.

Arch member 94*a* is connected to deck 110 by a similar telescoping connector 108, FIG. 5A. Sliding tube 142 is driven in and out of tubular body 121 by bolt 117. Lock nut 119 allows positive fixing of telescoping connector 108. Sliding tube 142 is welded to baseplate 144, which in turn is bolted to deck 110 by bolts 146 and 148. Tubular body 121 is attached to half-arch member 96 and full-arch member 94*a* by plates 131 and 129 welded to tubular member 121. Plates 131 and 129 are in turn bolted to structural arch members 94*a* and 96.

Fabric panel 116 can be easily removed and replaced from this panelized fabric-covered structure by simply loosening the fabric, sliding it off the structural members, and sliding a new fabric panel into place. To accomplish this, arch members 96 and 94*a* and transverse member 102, FIG. 4, are shortened by adjustment of telescoping connectors 108 and 122 respectively. This loosens fabric panel 116. Fabric panel 116 is connected to deck 110 by sill connector 150, FIG. 5B. Sill connector 150 includes a U-shaped channel member 155 with its open side facing out away from the fabric-covered structure. Member 155 is held down onto deck 110 by Z brackets such as brackets 151 and 153. To remove fabric panel 116, it is disengaged from sill connector 150 as described below and the panel is slid off of arch member 94*a* and transverse member 102.

After a new panel is put in place, telescoping connectors 108 and 122 are lengthened to tension the fabric. As transverse member 102, FIG. 4, is lengthened by connector 122, arch member 94*a* is pushed out away from the center of the structure. Since arch 94*a* is slightly flexible, it can bend to allow it to be pushed away from the center of the structure. Also, the fabric tension compresses the transverse members and they flex upward. This arching allows the transverse members to support themselves without additional support from a central support member. Alternatively, slot 135, FIG. 5A, shown in phantom, can be included. In this embodiment, as arch member 94*a* is pushed out, it pivots on bolt 136, and bolt 133 slides in slot 135. Then, when the tensioning is complete, bolts 133 and 136 are tightened to complete the replacement process.

Sill connector 150, FIG. 5B, attaches fabric panel 116 to deck 110. Channel member 155 is held down onto deck 110 by Z bracket 151. Bracket 151 is bolted to member 155 by bolt 332, and to deck 110 by bolt 330. Fabric panel 116 has tunnel 336 in its edge formed by looping the fabric edge back on itself and sewing the edge to the panel. One inch aluminum tube 334 is slid into tunnel 336, and locks panel 116 into connector 150. When the fabric is tensioned, tube 334 is pulled up against the opening in channel member 155, and fabric panel 116 rotates on tube 334 to find its seated position. To disengage panel 116 from sill connector 150, the panel is loosened and tube 334 is slid out from tunnel 336.

Figure 6A:
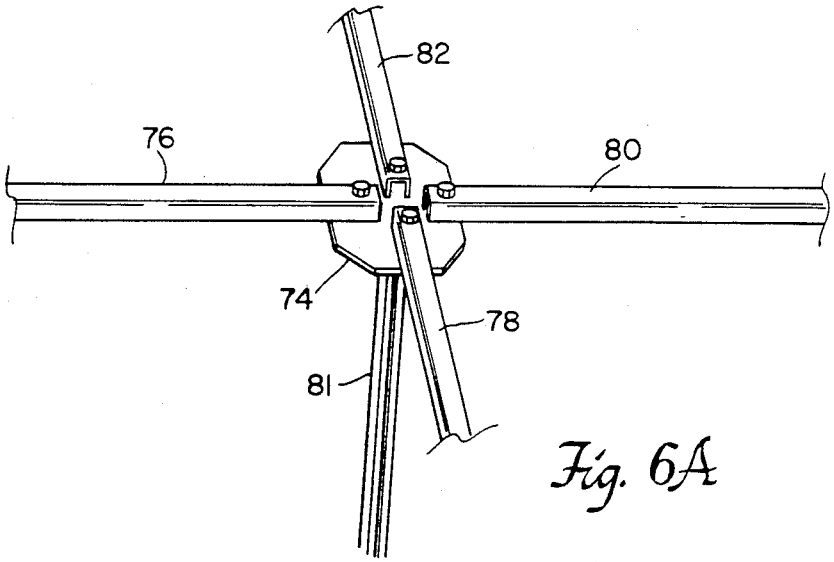
FIGS. 6A and 6B are axonometric and bottom plan views, respectively, of a central hub for connecting the transverse members of the structure of FIG. 2.
Figure 6B:
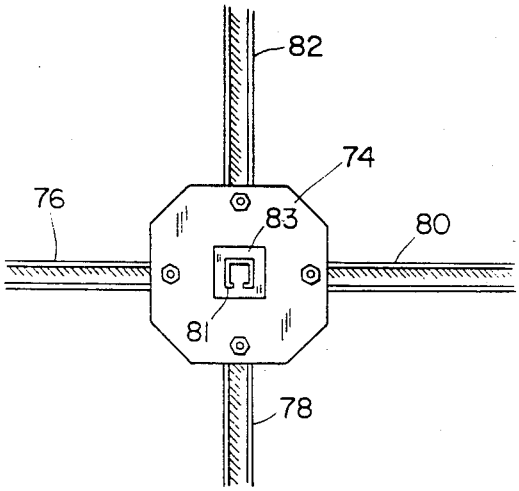

A central hub for interconnecting the transverse members at the center of the structure is shown in FIGS. 6*a* and 6*b*. Hub 74 is bolted to transverse members 76, 78, 80 and 82. Hub 74 allows use of relatively short transverse members, and also provides a means for adding a provisional center support member 81.

Center support member 81 is shown in cross section in FIG. 6*b*, which is a bottom plan view of the structure of FIG. 6*a*. Center support 81 is made from a length of U-shaped channel iron with flat plate 83 welded to its top end. Center support member 81 is put in place by merely positioning plate 83 against hub 74. If desired, plate 83 can be bolted to hub 74 to make center support 81 a permanent structural member.

Figure 7:
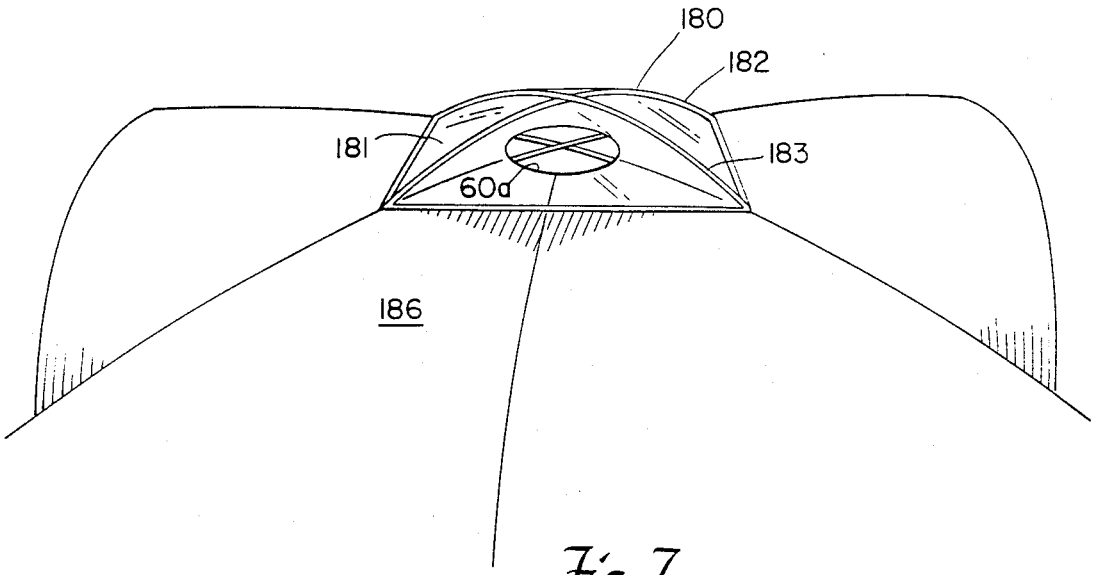
FIG. 7 is an axonometric view of a cover for the central vent opening of the structure of FIG. 2.

A cap for covering central vent 60*a* in structure 186 is shown in FIG. 7. Cap 180 is made from crossed, arched members 182 and 183 connected to the transverse members of structure 186 and covered by fabric cover 181. Cap 180 prevents rain and snow from entering structure 186 without sealing vent 60*a*.

Figure 8:
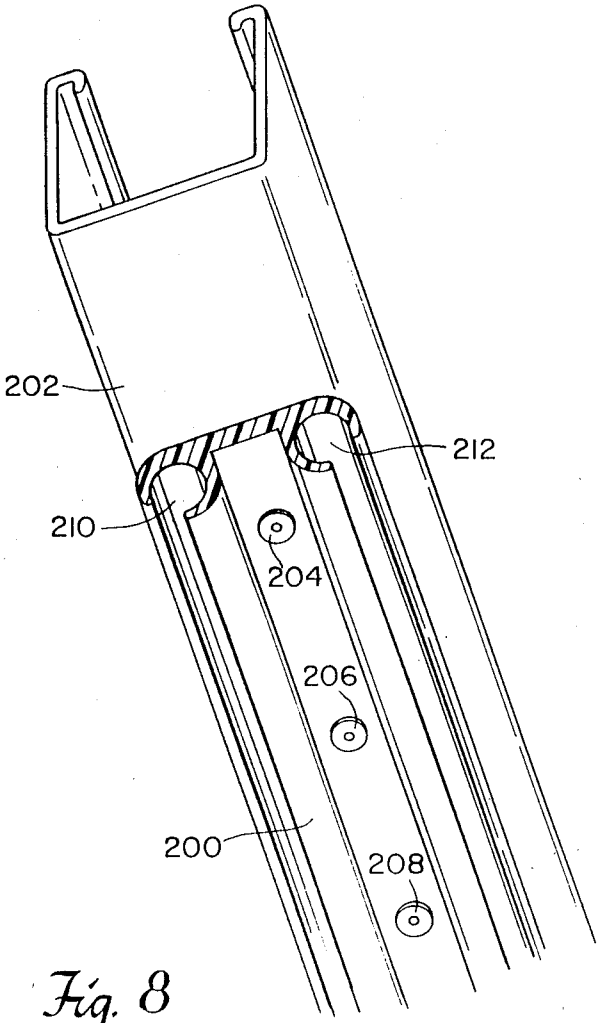
FIG. 8 is an axonometric, cross sectional, view of an inner welt connector attached to a transverse member of a fabric-covered structure according to this invention.

A welt connector for connecting fabric panels to a structural member is shown from below in FIG. 8. Connector 200 is riveted to the bottom of transverse member 202 by rivets 204, 206 and 208. Connector 200 includes partially open annular sections 210 and 212. Welt connector 200 may be made of metal, but is preferably an extruded plastic member that can be made in a variety of sizes and lengths for a particular structural application.

Figure 9A:
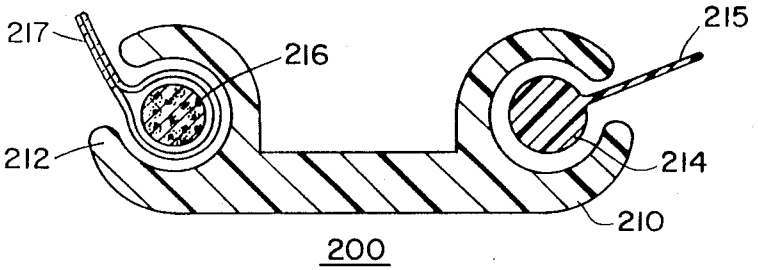
FIG. 9A is a cross-sectional view of the welt connector of FIG. 8.

Welt connector 200 is shown in cross section in FIG. 9A. Also shown in cross section are two types of fabric welts, 214 and 216, which slidingly engage with partially open annular sections 210 and 212 respectively. Welt 214 includes tongue 215 which provides a surface for attachment to a fabric panel. Preferably, welt 214 is an extruded plastic elongated cylinder that is larger than the opening in the partially open annular section, and small enough to slide into this section. The fabric panel is typically connected to the welt 214 by sewing the fabric onto tongue 215. Alternatively, the seam can be heat welded.

Welt 216 is a cloth bound cord or rope that has cloth strip 217 sewn around it. Welt 216 is preferably a Dacron wrapped bolt rope. Cloth strip 217 is preferably a Dacron strip that is sewn tightly around welt 216 and has the same function as tongue 215 of welt 214.

Figure 9B:
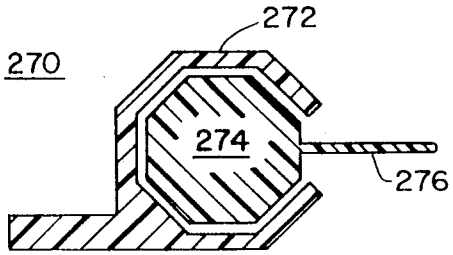
FIG. 9B is a cross-sectional view of an alternative form of the welt connector of FIG. 9A.

The annular welt connector and round welt is a preferred method of connecting the fabric panels to each other and the frame members. However, any partially on conduit can be used to connect the fabric panels to each other and the frame members. The interlocking and sliding engagement is then provided by attaching a sliding connector larger than the opening in the conduit and shaped to fit into and slide along the conduit to the edges of the fabric panels. For example, in FIG. 9B welt connector 270 includes partially open octagonal conduit section 272. Octagonal welt 274, with fabric connecting tongue 276, is shaped to slide into and interlock with conduit section 272. Welt connector 270 also details one embodiment of a single fabric panel connector which may be used to connect a single fabric panel to a structural member, for example to connect fabric panel 114, FIG. 3, to full arch member 98. However, a double fabric panel connector is preferably used to provide a place for attaching extensions or modular connectors in the future.

Figure 10:
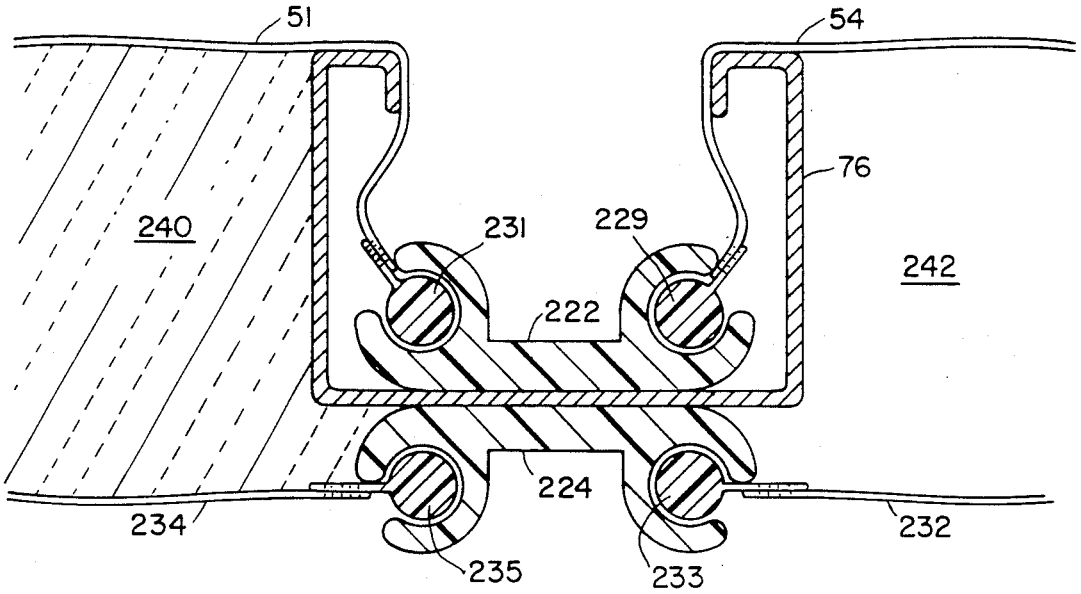
FIG. 10 is a cross-sectional view taken along line 10—10 of FIG. 2.

The usefulness of the preferred fabric connector arrangement is shown in FIG. 10. This figure is a cross sectional view of the panelized fabric-covered structure of FIG. 2 taken along line 10—10. Welt connector 222 is attached to the inside of U-shaped transverse member 76. Welt connector 224 is attached to the bottom side of transverse member 76. Outer eighth-part fabric panels 51 and 54 are connected to transverse member 76 by welt connector 222. Welt 231 is sewn to the edge of panel 51 and welt 229 is sewn to the edge of panel 54. The fabric panels are put onto the frame by sliding the welt into and along the length of the welt connector. Similarly, fabric panel 234 is attached to welt connector 224 by welt 235 sewn to fabric panel 234. Fabric panel 232 is sewn to welt 233, which also slidingly engages with welt connector 224. Each of these fabric panels is then connected to another panel by an identical welt connector that is slid onto the welts and forms a valley seam such as seam 52, FIG. 2.

Once the outer layer of fabric panels has been slid into place by feeding the welts along the partially open annular sections of the welt connectors, feeding an unsupported welt connector up along the butting free edges of the fabric panels, and connecting the fabric panels to the deck with a sill connector, the fabric-covered structure is expanded and the fabric tensioned using the telescoping connectors shown in FIGS. 4 and 5 and described above. As the frame members are lengthened and the fabric is tensioned, the welts sewn into the edge of the fabric panels slide and/or rotate in the annular sections of the connectors. This movement allows the fabric panels to seat properly in relation to the structural members and each other as the structural members are lengthened and the fabric panels tensioned. Thus, when completely assembled, the panelized fabric-covered structure is covered by a single layer of tightly tensioned fabric. The inner fabric layer is typically a light cotton fabric that can be slid into place along the welt connectors after the outer fabric layer is tensioned. This inner layer is typically tied down to the deck to keep it in place.

The space between the two layers of fabric can be useful for heating and/or cooling the structure. Insulation 240 can be added to fill this space to insulate the structure from the cold and retain heat within the structure to allow it to be used in cooler climates. Alternatively, space 242 between the fabric layers can be left open.

In warm climates, the fabric-covered structure can include a single layer of fabric panels. The fabric can be a mesh or cotton fabric that provides shelter, shade and ventilation. Preferably, the fabric is cut along the bottom edges so it arcs between points of attachment to the supporting surface. If the fabric cover is tied down only at the arch legs and valley points, the arched fabric edge provides plenty of open space to allow air movement through the structure to keep the interior cool.

By merely making the welt connector with a desired number of partially open annular conduit sections to accommodate a desired number of fabric panels, a panelized fabric-covered structure according to this invention can be made with a desired number of fabric layers, each made from a desired number of fabric panels. Preferably, the panels are identical so they can easily be replaced or interchanged.

Figure 11:
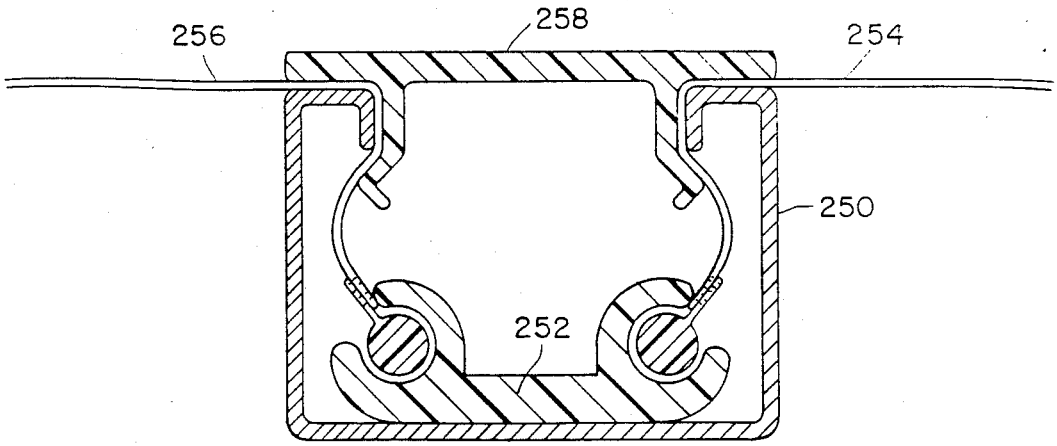
FIG. 11 is a cross-sectional view of a cap sealing the open side of a U-shaped transverse member of the structure of FIG. 8.

A sealed U-shaped structural member is shown in FIG. 11. Transverse member 250 has welt connector 252 attached to it. Fabric panels 256 and 254 are attached to transverse member 250 by welt connector 252. Once these panels are in place, plastic cap 258, which may be a cap enclosure strip manufactured by UNISTRUT, can be force-fitted into the opening in transverse member 250 to seal this opening. This sealing is important because the threads used to sew the fabric pieces to the welts may rot if they are exposed to sunlight and/or moisture. Cap 258 keeps these threads from exposure by sealing the open side of transverse member 250, yet is easily removed as required when the fabric panels are being removed and replaced.

Figure 12:
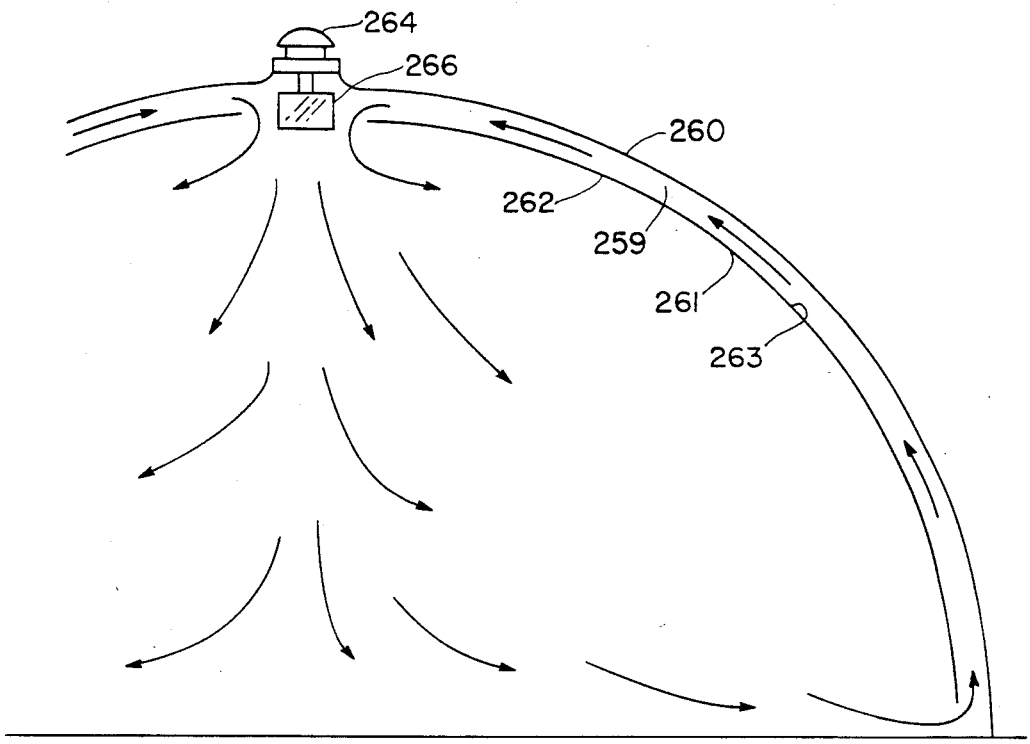
FIG. 12 is a diagrammatic view of forced air circulation for heating a two-fabric layer embodiment of the structure of FIG. 2.

An alternative method of employing a two-layer fabric structure in cooler climates is shown in FIG. 12. Fabric layers 260 and 262 are separated by space 259. Fan 164 is placed at the center of the structure and includes fan blade 266 which draws air up between the fabric layers and out into the interior of the structure as shown by the arrows. Air in space 259 is heated by solar radiation by making the outer fabric layer 260 from a translucent fabric which transmits sunlight. Inner fabric layer 262 has a dark outer surface 263 and a reflective inner surface 261. Sunlight transmitted through outer layer 260 is absorbed by dark surface 263. This energy then warms the air held in space 259. The warm air is drawn up between the layers and blown back into the interior of the structure by fan 264 as shown by the arrows. Reflective surface 261 reflects radiant energy and minimizes energy loss through fabric layer 262.

Figure 13:
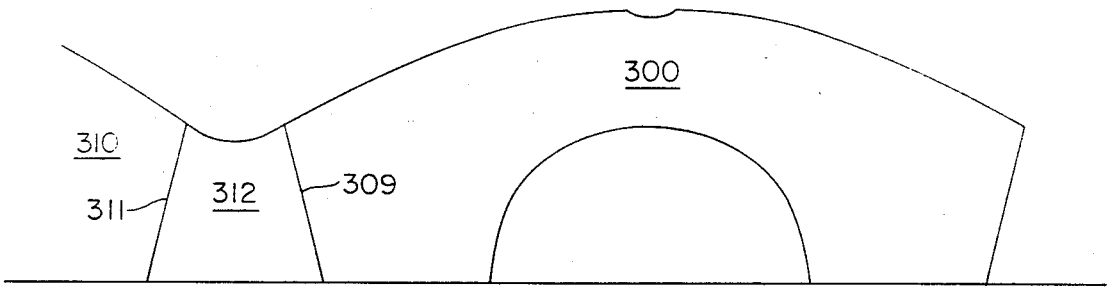
FIG. 13 is an elevational view of a modular connector for interconnecting panelized fabric-covered structures according to this invention.

A modular connector for interconnecting similar or different fabric-covered structures is shown in FIG. 13. Structure 300 is connected to structure 310 by modular connector 312. Connector 312 may simply be a wedge-shaped fabric panel with welts sewn into its edges to slidingly engage with welt connectors, not shown, on arch 309 of structure 300 and arch 311 of structure 310. Alternatively, connector 312 can include a transverse member, not shown, attached to the apices of arches 309 and 311. This transverse member provides structural support for cover 312, and also helps to keep structures 300 and 310 properly spaced.

Modular connector 312 can also be made in a slightly different shape to interconnect different sized or shaped fabric covered structures according to this invention. For example, if structure 310 is larger than structure 300, connector 312 is simply made non-symmetric to facilitate the interconnection.

Figure 14:
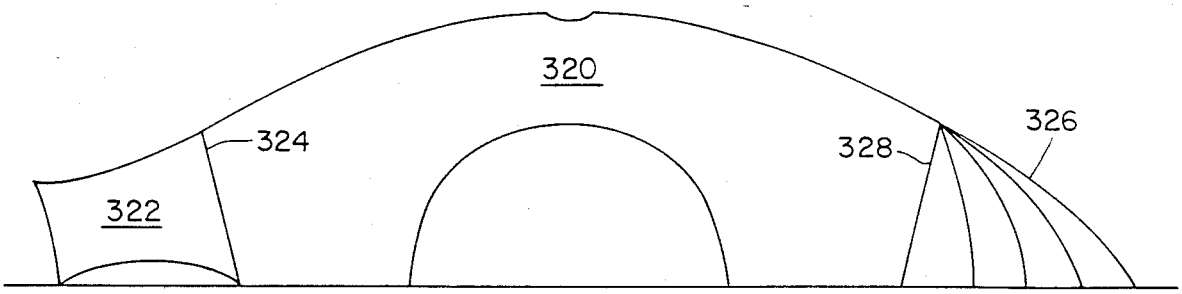
FIG. 14 is an elevation view of extensions that can be added to the panelized fabric-covered structure according to this invention.

Awning extension 322 and half-shell extension 326, FIG. 14, are two examples of fabric-covered additions that can easily be made to fabric-covered structure 320. Awning 322 is a fabric awning that includes a welt sewn into its edge to engage with a welt connector attached to arch 324. Once the awning is slid into place, it can be held up with poles or other structural members, not shown.

Half shell extension 326 is similarly attached to arch 328, and may be a fabric piece that may or may not include supporting structural members. Supporting structural members, for example arched ribs, can be included to support extension 326 to increase the head room and make extension 326 more useful as a permanent addition. Extensions 322 and 326 are only two examples of the many types of extensions that can be added to the fabric-covered structure of this invention to increase the comfort and beauty of the structure.

Although a preferred embodiment of this structure has been described as a panelized fabric-covered structure having four arch members facing a common center, a panelized fabric-covered structure according to this invention can be made virtually any shape or size. The frame itself can take almost any shape. Frames made from arch members can include two or more arches interconnected by one or more transverse members. In addition, the fabric cover can be made from almost any number of fabric panels. Since the welt connector can be used to connect one or more fabric panels to a frame member and to interconnect two or more fabric panels, virtually any number of fabric panels and frame members can be used to form the panelized fabric-covered structure according to this invention.

Although specific features of the invention are shown in some drawings and not others this is for convenience only as each feature may be combined with any or all of the other features in accordance with the invention.

Other embodiments will occur to those skilled in the art and are within the following claims:

What is claimed is:

1. A panelized fabric-covered structure with removable and replaceable fabric panels comprising:

an expandable frame, including a plurality of rigid, substantially vertical frame members interconnected by a plurality of rigid transverse frame members, for holding a fabric cover;

means for attaching said substantially vertical frame members to a supporting surface;

a fabric cover including a plurality of discrete fabric panels each having at least one enlarged edge;

connector means for connecting said enlarged edges of said fabric panels to each other and to said frame; said connector means including a channel member for engaging said enlarged edge of said fabric panels, said channel member including a longitudinal bore larger than said enlarged edge with an opening smaller than said enlarged edge for allowing said panels to slide and rotate in said connector means to seat said panels in said frame and in relation to each other;

means for adjusting the length of said transverse members to tension said panels in the direction of said transverse members; and means for adjusting the length of said substantially vertical frame members to tension said panels in the direction of said members to provide a taut fabric cover tensioned in transverse directions.

2. The panelized fabric-covered structure of claim 1 in which said fabric panels include a reflective surface for reflecting radiant energy.

3. The panelized fabric-covered structure of claim 1 in which said frame members include channel members.

4. The panelized fabric-covered structure of claim 3 further including a cap member for sealing the opening in said channel members.

5. The panelized fabric-covered structure of claim 1 in which said enlarged edge includes a welt attached to an edge of said fabric panels to provide sliding engagement with said channel member to allow said fabric panels to be removed and replaced.

6. The panelized fabric-covered structure of claim 1 in which said channel member includes a partially open annular conduit.

7. The panelized fabric-covered structure of claim 6 in which said enlarged edge includes a substantially cylindrical welt attached to an edge of said fabric panels to provide sliding and rotational engagement between said fabric panels and said connector means.

8. The panelized fabric-covered structure of claim 7 in which said welt is wider than the opening in said annular section to provide interlocking sliding and rotational engagement between said fabric panels and said connector means.

9. The panelized fabric-covered structure of claim 7 in which said welt includes a continuous elongate member.

10. The panelized fabric-covered structure of claim 1 in which said frame includes a plurality of arch members each having at least two legs and facing a common center and a plurality of transverse members interconnecting said arch members.

11. The panelized fabric-covered structure of claim 10 in which each said arch member includes at least one substantially vertical member for holding a rigid structure.

12. The panelized fabric covered structure of claim 10 further including means for pivotally attaching at least one of said arch members to a supporting surface.

13. The panelized fabric-covered structure of claim 10 further including means for adjusting the height of said arch members to expand said frame and tension said fabric panels.

14. The panelized fabric-covered structure of claim 13 in which said means for adjusting the height of said arch members provides independent adjustment of the length of each leg of each said arch member.

15. The panelized fabric-covered structure of claim 10 in which each said transverse member extends from the apex of an arch member toward said common center.

16. The panelized fabric-covered structure of claim 15 further including a central hub member for interconnecting said transverse members.

17. The panelized fabric-covered structure of claim 16 in which said frame includes a central support member for supporting said hub member.

18. The panelized fabric-covered structure of claim 1 in which said fabric panels are interchangeable.

19. The panelized fabric-covered structure of claim 10 further including a connecting structure for attaching an arch member of said panelized fabric-covered structure to an arch member of a second panelized fabric-covered structure to interconnect two closely spaced fabric-covered structures.

20. The panelized fabric-covered structure of claim 19 in which said connecting structure includes at least one fabric panel for attachment to two closely spaced, substantially opposing arch members, one disposed in each panelized fabric-covered structure.

21. The panelized fabric-covered structure of claim 19 in which said second structure is identical to said panelized fabric-covered structure.

22. The panelized fabric-covered structure of claim 1 in which said cover includes a plurality of spaced layers of fabric panels.

23. The panelized fabric-covered structure of claim 22 further including insulation means for filling the space between at least two of said layers.

24. The panelized fabric-covered structure of claim 22 further including means for circulating air between said layers.

25. The panelized fabric-covered structure of claim 22 in which the top fabric layer includes translucent fabric panels for transmitting sunlight.

26. The panelized fabric-covered structure of claim 22 in which the bottom fabric layer includes fabric panels having a dark surface for absorbing radiant energy.

27. The panelized fabric-covered structure of claim 22 in which the bottom fabric layer includes fabric panels have a reflective surface for reflecting radiant energy.

28. The panelized fabric-covered structure of claim 1 in which said cover includes a central opening for venting said structure.

29. The panelized fabric-covered structure of claim 28 further including a screened cover for said opening.

30. The panelized fabric-covered structure of claim 28 further including a cap for covering said central opening and venting said structure.

* * * * *